United States Patent [19]

Johnson

[11] Patent Number: 4,833,895

[45] Date of Patent: May 30, 1989

[54] SPIN DISK EVAPORATOR

[76] Inventor: Dwight N. Johnson, 6327 Chorlito Dr., Carlsbad, Calif. 92008

[21] Appl. No.: 178,292

[22] Filed: Apr. 6, 1988

[51] Int. Cl.[4] ..... F28D 5/00

[52] U.S. Cl. ..... 62/304; 261/84

[58] Field of Search ..... 261/32, 83, 84, 85, 261/88, 89, 90, 91; 62/304, 309, 310, 311

[56] References Cited

U.S. PATENT DOCUMENTS

| | | | |
|---|---|---|---|
| 1,626,667 | 3/1927 | Cramer et al. . | |
| 3,065,956 | 11/1962 | Meek | 261/83 X |
| 3,474,597 | 10/1969 | Eckert | 261/84 X |
| 4,458,844 | 7/1984 | Mitsui . | |

*Primary Examiner*—Henry A. Bennet

*Attorney, Agent, or Firm*—Mason, Kolehmainen, Rathburn & Wyss

[57] ABSTRACT

A spin disk evaporator includes a pan suspended from a cage enclosing a motor rotating a spin disk and a fan for moving an air stream across the pan and outward for the evaporator. The disk includes a cone-shaped tip immersed in water held in a sump portion of the pan. Rotation of the disk causes a film of water to be picked up by the tip and moved across a water transfer surface to a circumferential wall of the disk. Water collected on the inner surface of the wall separates and moves through grooves from the inner surface of the wall across the end of the wall to the outer surface. Water exits from the grooves at a circular edge and is dispersed into the air stream as extremely fine water particles.

15 Claims, 2 Drawing Sheets

12
64
72
80
94
78
90
W4
76
88
W5
92

76
82
94
84
12
68
86
80
70
66
90

12
84
90
88
78
70
66
92
76

4
5
6
76
78
90
88
W5
94
80
W4
84
68
86
W3
72
W2
64
12
70
66
92

2
76
88
80
84
94
82
78
86
68
72
66
64
12
92

SPIN DISK EVAPORATOR

The present invention relates to apparatus for cooling, humidification, misting or the like by evaporation of water, and to an improved spin disk for dispersing water particles of small size.

BACKGROUND OF THE INVENTION

Systems using the evaporation of water have been used in arid climates for cooling purposes. A typical installation for cooling a structure includes a motor driven blower for moving air through wetted porous evaporation pads. Such systems are complex and expensive because they typically require a sump with water level controlled by a float valve, and a recirculating pump with a water distribution piping system to keep the evaporative pads moist. The necessity for periodic pad change is a problem.

Evaporative systems have also been used for humidification of greenhouses, and in the printing and weaving industries to maintain a desired moisture content in paper and textile materials. In addition, evaporative systems are useful for mist generation in plant nurseries, produce markets and for dust control and the like. For some of these applications, fog systems incorporating pumps and nozzles have been used. Such fog systems are expensive, difficult to install and often require both filtering and feed water treatment for the removal of minerals.

U.S. Pat. No. 1,626,667 discloses a humidifier with a motor driven conical member for lifting water from a container and supplying the water to a spin disk member having a circumferential rim. Centrifugal force causes particles of water to be thrown from the rim against a surface in the path of a stream of air provided by a fan driven by the motor. The humidifier disclosed in this patent has advantages such as simplicity and low cost not enjoyed by currently used evaporative systems such as those described above. However, the humidifier disclosed in U.S. Pat. No. 1,626,667 is not capable of dispersing a large quantity of extremely fine water particles into an air stream. As a result, the uses to which that device could be put are quite limited.

U.S. Pat. No. 4,458,844 discloses a rotary paint atomizing device in which a rotary disk or bell having a grooved edge configuration is used to atomize paint particles in an electrostatic field. The disk configuration disclosed in that patent would not be well adapted to evaporative apparatus because it is not capable of providing the small particle size desirable for evaporation. In the grooved edge configuration disclosed in U.S. Pat. No. 4,458,844, the grooves lead to a radially oriented end surface of uniform width upon which paint to be atomized collects prior to separation from the disk. As surface tension of the paint collected on this surface is overcome by centrifugal and electrostatic forces, particles of paint are "torn" from the disk. This is intended to provide particle size uniformity, but prevents the formation of particles of a small size.

SUMMARY OF THE INVENTION

A primary object of the present invention is to provide a spin disk evaporator in which a large number of water particles of extremely small size are dispersed into an air stream. Other objects of the invention are to provide a spin disk evaporator useful as an outdoor area cooler or for cooling, misting or humidifying indoor regions for a wide variety of purposes; to provide an improved spin disk from which numerous particles of extremely small size, such as 50 microns and less can be dispersed by centrifugal force; to provide a spin disk evaporator of simple construction and low cost; and to provide improvements in evaporative systems overcoming disadvantages of those used in the past.

In brief, the above and other objects and advantages of the present invention are achieved by providing evaporative apparatus including a pan and a conduit for delivering water to the pan. A motor is mounted above the pan and includes a motor shaft carrying a fan for moving a stream of air past the region of the pan. A spin disk is coupled to the motor for removing water from the pan and disbursing particles of the water into the stream of air. The spin disk has a hub portion including an upwardly disposed hub connected to the motor shaft and a downwardly projecting cone shaped tip immersed in the water in the pan. A body portion of the disk extends radially and upwardly to define a lower water transfer surface for the travel of water from the tip. A circumferential wall coaxial with the hub has an inner surface intersecting the water transfer surface for collecting water travelling from the water transfer surface. The circumferential wall includes a radially outwardly directed outer surface. A plurality of water dispersion passages extend from the inner surface to the outer surface and act in the nature of numerous tiny spouts for permitting water particles of small size to disperse before collecting or enlarging upon a surface of the disk.

DESCRIPTION OF THE VIEWS OF THE DRAWING

The present invention together with the above and other objects and advantages may be best understood from the following detailed description of the embodiment of the invention illustrated in the drawings, wherein.

DETAILED DESCRIPTION OF THE PREFERRED EMBODIMENT

Figure 1:
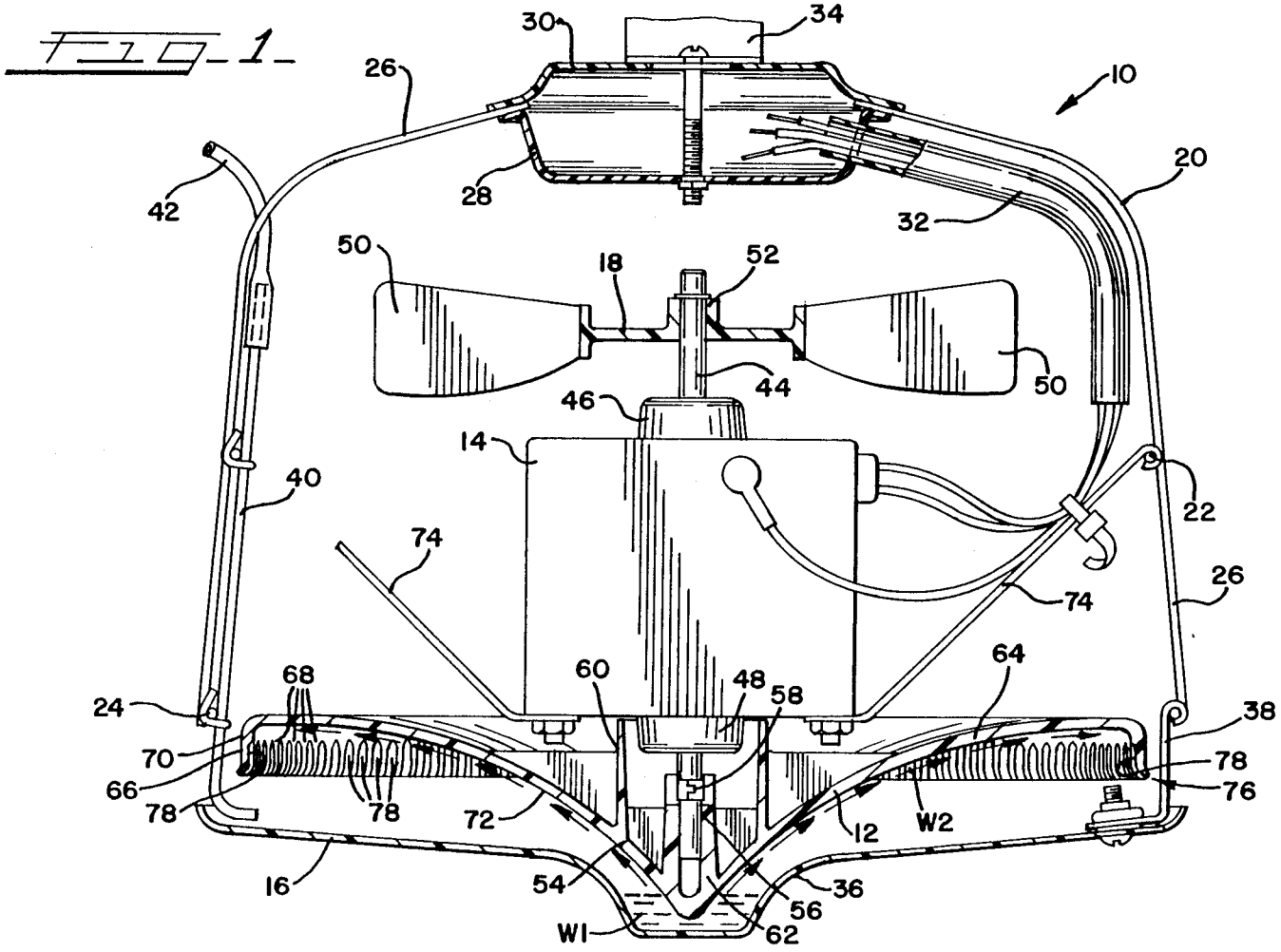
FIG. 1 is an elevational side view, partly in section, of a spin disk evaporator embodying the present invention.
Figure 3:
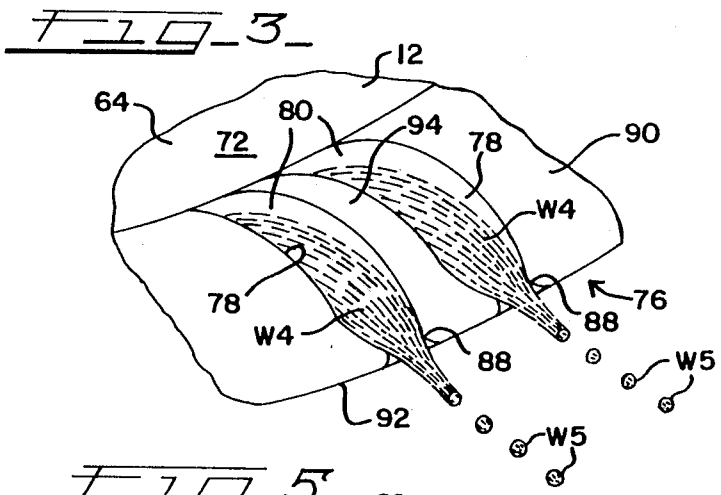
FIG. 3 is a fragmentary perspective view of a small segment of the periphery of the disk.
Figure 5:
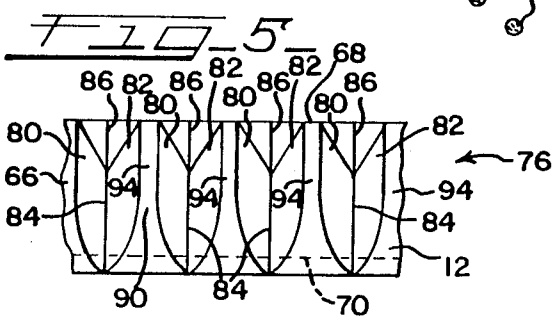
FIG. 5 is a plan view of the end of the periphery of the disk taken from the line 5—5 of FIG. 2.
Figure 6:
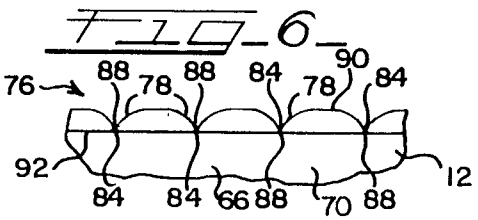
FIG. 6 is a fragmentary, elevational view taken from the line 6—6 of FIG. 2.

Having reference now to the drawings, and initially to FIG. 1, there is illustrated an evaporative cooling device designated as a whole by the reference character 10 and constructed in accordance with the principles of the present invention. In general, the device 10 includes a spin disk 12 incorporating important features of the invention rotated by a motor 14 for dispersing water from a pan 16 into an air stream moved by a fan 18.

More specifically, the evaporative cooler 10 incorporates a wire form protective cage 20 fabricated of upper and lower circular members 22 and 24 joined to numerous outwardly and downwardly extending wire elements 26 only two of which are illustrated in FIG. 1. Cage 20 permits free movement of air to and from the fan 18 while preventing injury that could result from contact with the rotating fan 18 or disk 12.

Upper ends of wire elements 26 are captured between a cup member 28 and cap 30 defining an enclosure for electrical connections to a conduit 32 with conductors extending to the motor 14. A bale or bracket 34 permits the device 10 to be suspended from an overhead support, ceiling or the like.

Pan 16 is generally circular or disk shaped and includes a central sump portion 36 generally aligned with the central vertical axis of the device 10. A number of hanger brackets 38 connected between the lower wire element 24 and the peripherally outer area of the pan 16 suspend the pan below the cage 20. Any dispersed water collected on brackets 38 is returned to the pan 16 and sump 36.

A supply of water is introduced into sump portion 36 of pan 16 through a supply tube 40. The inlet end of supply tube 40 is connected to an elongated flexible tube 42. Flow restriction for metering the flow of water to the sump 36 is accomplished by using a flexible tube 42 of capillary dimensions, for example having an inside diameter of about 1/16 inch. If desired, water may be supplied to the device 10 using a suitable flow metering control making use of the restriction of tube 42. The capillary tube has advantages over a conventional metering flow restriction in that the capillary tube may be of larger size and less susceptible to clogging or blockage.

Motor 14 is preferably a small, high speed electric motor operating, for example, at about 3200 RPM. A motor shaft 44 extends both above and below the housing of the motor 14 through upper and lower bearings 46 and 48. Fan 18 includes a number of fan blades 50 arrayed around a fan hub 52 mounted on the upwardly extending end of motor drive shaft 44. Blades 50 draw air generally downwardly from above and around the device 10 and move a stream of air past the motor 14 and radially outward across the outer regions of the spin disk 12 and outwardly from the device 10 generally in the radial direction for a distance of several feet.

Spin disk 12 includes a central hub portion 54. A central, axial, upwardly extending hub socket 56 is received over the lower end of the motor drive shaft 44 and is fixed in place by a clamp 58. A cylindrical skirt wall 60 surrounds the hub 56 and protects the lower motor bearing 48 from water that might collect upon the disk 12 due to rainfall or the like.

The underside of hub portion 54 defines a generally cone-shaped tip 62 of disk 12 at the center of the disk. Tip 62 extends into sump portion 36 of pan 16 and is immersed in water delivered to the pan through tubes 40 and 42. A body portion 64 of disk 12 extends radially outwardly and upwardly from the tip 62. As seen in FIG. 1, the tip 62 and body portion 64 merge together in a curved, continuous shape symmetrical about the central axis of the disk 12.

The outer periphery of the disk 12 is provided with a continuous, generally circular, downwardly depending circumferential wall 66. The wall 66 is generally in the form of a circular cylinder oriented in the axial direction and symmetrical about the axis of rotation of the disk. Wall 66 includes a radially inner surface 68 and a radially outer surface 70.

When the disk 12 is rotated by the motor 14, water is picked up by the cone-shaped tip 62 and due to surface tension and centrifugal force, water travels upwardly and outwardly from the tip 62 along a water transfer surface 72 defined on the underside of the body portion 64 of the disk 12. As a thin film of water moves across the water transfer surface 72 toward the wall 66, the film may become fragmented and irregular. Water is collected by centrifugal force against the inner surface 68 of the wall 66. The water collected in this region is dispersed radially outwardly away from the disk 12 as a large number of very small water particles as discussed below in connection with FIGS. 2–6.

Motor 14 is suspended from the upper circular wire element 22 by a plurality, such as four, of motor support straps or brackets 74. Each bracket 74 extends inwardly and downwardly from member 22 to the lowermost portion of the casing of motor 14. Each bracket extends along a line, and extensions of these lines coincide at the central axis of the motor 14 and disk 12 in the vicinity of the tip 62. This provides a focal mount minimizing shake or run out of the tip 62 due to vibration of motor 14. As a result, even distribution of water film upon the tip 62 and water transfer surface 72 is assured.

Having reference now to FIGS. 2–6, the disk 12 of the present invention is provided with an edge or rim structure generally designated as 76 providing dispersed water particles of a minimum size, preferably less than fifty microns. Small particles of this size are highly desirable in an evaporative apparatus. Small particle size maximizes the aggregate water surface area exposed to air for a given volume of dispersed water and promotes rapid evaporation or flashing of dispersed water in dry air.

More specifically, a multiplicity of regularly spaced water flow passages 78 are arrayed around the circumference of the disk 12. For example, passages 78 may be employed at one degree intervals, for a total of 360 discrete and spaced apart passages. In the preferred embodiment of the invention, passages 78 take the form of V-shaped grooves defined between side walls 80 and 82 providing a sharp bottom 84 to each groove 78. Preferably the walls 80 and 82 are oriented at sixty degrees to one another. Passages of configurations other than grooves or grooves having different shapes may be employed if desired.

Each groove 78 includes an entrance end 86 and an exit end 88. The entrance ends of the grooves 78 are located at the inner surface 68 of circumferential wall 66 at a region axially spaced from a distal end portion 90 of the wall 66. The exit end 88 of each groove is located at the outer surface 70 of the wall 66. Thus, each groove extends along part of the inner surface 68 and entirely across the full extent of the end portion 90 of the wall 66.

A circular edge 92 is defined adjacent the junction of the outer surface 70 and the end portion 90 of the wall 66. Edge 92 is continuous and uninterrupted around the entire circumference of the disk 12. The exit end 88 of each groove 78 is located at circular edge 92, with the sharp bottom 84 of each groove 78 intersecting the edge 92. Edge 92 is axially spaced away from the distal end portion 90 and is disposed radially outside of the adjacent portions of the outer surface 70 of wall 66. In the illustrated embodiment, the circular edge 92 is the radially outermost part of the disk 12.

Figure 2:
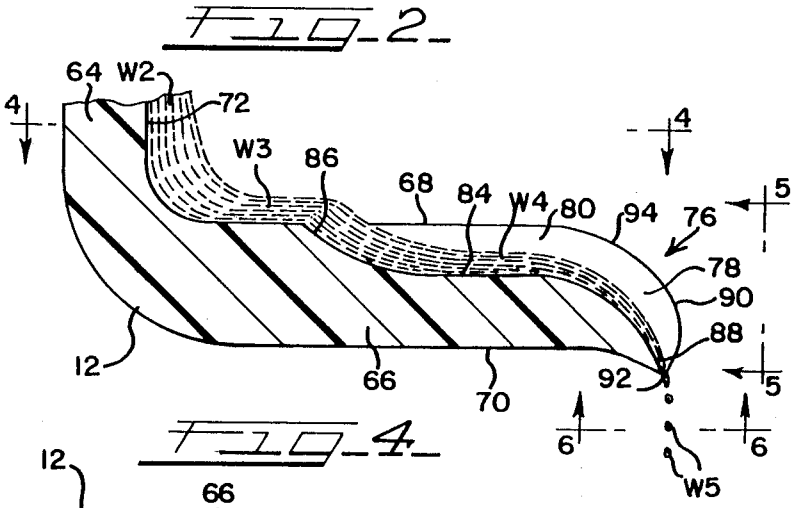
FIG. 2 is a greatly enlarged, fragmentary, sectional view of a portion of the periphery of the spin disk of the evaporator of FIG. 1 taken along the line 2—2 of FIG. 4 and illustrating the dispersion of particles of water from the disk.
Figure 4:
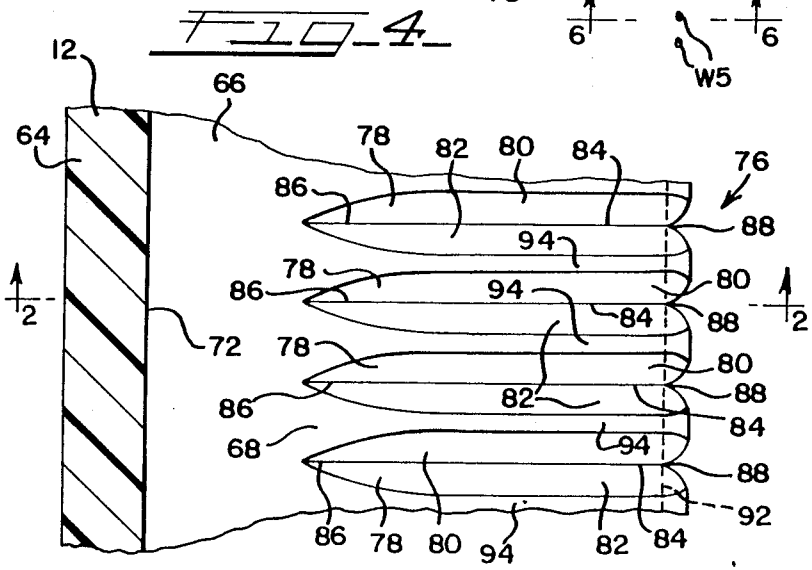
FIG. 4 is a partly sectional and elevational view taken from the line 4—4 of FIG. 2.

As best seen in FIG. 2, the edge 92 is a sharp edge because it is defined at a cusp where the outer surface 70 of wall 66 intersects the end portion 90 of wall 66. While both the end portion 90 and the outer surface 70 are curved near the intersection at edge 92, the curves are not continuous. Rather, they meet at a discontinuous point (viewed in section) providing the sharp edge 92 upon which water is unable to collect. Moreover, each groove 78 is isolated or separated from adjacent grooves 78 by nongrooved, tooth or comb like portions 94 of the end portion 90 extending axially beyond the edge 92 and bottom 84 of the passages 78. As a result, each groove 78 acts like a spout in which a thread like stream of water is reduced in cross section and from which water is dispersed without collecting at the end of the groove 78.

In operation of the evaporative cooler 10, a supply of water W1 (FIG. 1) is supplied to the sump portion 36 of pan 16 by tubes 42 and 40. The cone-shaped tip 62 of disk 12 picks up water from the sump, and a film of water W2 (FIG. 2) moves upwardly and outwardly across the water transfer surface 72 defined on the underside of the body portion 64 of disk 12.

Water reaching the circumferential wall 66 is collected in a uniform annular body W3 forced radially outwardly by centrifugal force against the inner surface 68. The body of water W3 is uniformly segregated into discrete thread-like flows of water W4, one in each groove 78. Discrete streams W4 are separated from one another by the tooth-like portions 94 of circumferential wall 66.

Each stream W4 decreases in size as it flows under the effect of centrifugal force from the entrance end 86 to the exit end 88 of each groove 78. Streams W4 flow both axially and radially for a distance sufficient for the stream to decrease in cross section at the bottom 84 of the groove 78 between side walls 80 and 82. Since walls 80 and 82 are at sixty degrees to one another, the sectional shape of each stream W4 is roughly that of an equilateral triangle of small area. At the exit end 88, the stream W4 is exceedingly fine or small in cross section as it reaches the edge 92.

The exit end 88 of each groove 78 acts like a spout directly opening away from the disk 12 at the circular sharp edge 92. This spout effect acting in combination with the sharp circular edge 92 assures that there is no surface or region at the downstream ends of passages 78 where the fine streams W4 of water can collect into larger volumes of water before being separated from the disk 12 by centrifugal force.

As the streams W4 exit from passages 78 in the form of an exceedingly fine streams or threads, each is dispersed in the shape of particles W5. Since there is no opportunity for water to collect after exiting from passages 78, the particles W5 are extremely small in size, preferably no larger than fifty microns.

In a preferred embodiment of the invention, the diameter of the spin disk 12 is about nine inches. The depth of the wall 66 is about ½ inch. The maximum depth of each groove 78 is about 0.05 inch and the included angle between side walls 80 and 82 is sixty degrees. The length of each groove 78 is about 0.4 inch. Surfaces 70 and 90 meet at an angle of about ninety degrees to define the circular edge 92.

While the invention has been described with reference to details of the illustrated embodiment, such details are not intended to limit the invention as defined in the accompanying claims.

What is claimed and desired to be secured by Letters Patent of the United States is:

1. A spin disk for an evaporative cooling, humidification or like device comprising:

a hub including means for mounting the disk to spin about its central axis;

a body portion extending outwardly from said hub at least partly in a radial direction;

a liquid wettable surface defined on one axial side of said body portion;

a circumferential wall generally coaxial with said central axis and having radially inner and outer surfaces, said inner surface extending from said liquid wettable surface; and a multitude of liquid passageways arrayed regularly around the circumference of the disk, each passageway having an entrance end and an exit end;

said entrance ends of said passageways being located in said inner surface of said circumferential wall and said exit ends of said passageways being located at said outer surface of said circumferential wall;

said exit ends being both axially and radially spaced from said entrance ends.

2. A spin disk as claimed in claim 1, said circumferential wall having a free end portion spanning said inner and outer surfaces at one axial end of said circumferential wall, at least part of said exit ends of said passageways being axially spaced from said free end portions.

3. A spin disk as claimed in claim 2, said passageways comprising grooves extending along said inner surface of said circumferential wall and across the full width of said free end portion to said outer surface of said circumferential wall.

4. A spin disk as claimed in claim 3, said grooves having sharp bottoms.

5. A spin disk as claimed in claim 4, said grooves being V-shaped in section with side walls oriented at approximately sixty degrees.

6. A spin disk as claimed in claim 1, further comprising a circular sharp edge adjacent the junction of said free end and said outer surface, said edge being axially spaced from the distal extremity of said free end, and said exit ends of said passageways being located at said sharp edge.

7. A spin disk as claimed in claim 6, said sharp edge being farther from said central axis than adjacent portions of said outer surface.

8. A spin disk as claimed in claim 5, further comprising a circular sharp edge adjacent the junction of said free end and said outer surface, said edge being axially spaced from the distal extremity of said free end, and the sharp bottoms of said grooves being located at said sharp edge.

9. A spin disk as claimed in claim 1, said circumferential wall being generally axially oriented.

10. Evaporative apparatus for cooling, humidification or the like comprising:

a pan;

a conduit for delivering water to said pan:

a motor mounted above said pan and having a motor shaft;

a fan coupled to said motor shaft for moving a stream of air past the region of said pan;

a spin disk coupled to said motor for removing water from said pan and dispersing particles of water into said stream of air;

said spin disk having a hub portion including an upwardly disposed hub connected to said motor shaft and a downwardly projecting generally cone shaped tip immersed in water in said pan;

a body portion of said disk extending radially and upwardly from said tip and defining a lower water transfer surface for the travel of water radially and upwardly from said tip;

a circumferential wall generally coaxial with said hub and having an inner surface merging with said water transfer surface for collecting water travelling from said water transfer surface;

said circumferential wall including a radially outwardly directed outer surface; and a plurality of water dispersion passages extending in both axial and radial directions from said inner surface to said outer surface.

11. Apparatus as set forth in claim 10, said fan including a hub connected to said motor shaft above said motor.

12. Apparatus as set forth in claim 10, said conduit comprising a capillary flow restriction tube.

13. Apparatus as set forth in claim 10 further comprising focal mounting means for said motor for defining the center of motor vibration in the region of said tip.

14. Apparatus as set forth in claim 11, further comprising a cage surrounding said motor and fan, said focal mounting means comprising a plurality of brackets extending downwardly nd inwardly from said cage coinciding with lines generally intersecting at said tip.

15. Apparatus as set forth in claim 14, further comprising means for suspending said pan from said cage.

* * * * *